US010393341B2

(12) United States Patent
McCanless

(10) Patent No.: US 10,393,341 B2
(45) Date of Patent: Aug. 27, 2019

(54) TRI-LOBE OPTIC AND ASSOCIATED LIGHT FIXTURES

(71) Applicant: ABL IP HOLDING LLC, Conyers, GA (US)

(72) Inventor: Forrest Starnes McCanless, Oxford, GA (US)

(73) Assignee: ABL IP Holding LLC, Atlanta, GA (US)

( * ) Notice: Subject to any disclaimer, the term of this patent is extended or adjusted under 35 U.S.C. 154(b) by 414 days.

(21) Appl. No.: 14/696,042

(22) Filed: Apr. 24, 2015

(65) Prior Publication Data

US 2016/0312960 A1 Oct. 27, 2016

(51) Int. Cl.

| | |
|---|---|
| ***F21V 3/02*** | (2006.01) |
| ***F21V 13/02*** | (2006.01) |
| *F21V 23/02* | (2006.01) |
| *F21V 15/015* | (2006.01) |
| *F21Y 105/16* | (2016.01) |
| *F21Y 115/10* | (2016.01) |

(52) U.S. Cl.

CPC ..... *F21V 3/02* (2013.01); *F21V 13/02* (2013.01); *F21V 15/015* (2013.01); *F21V 23/02* (2013.01); *F21Y 2105/16* (2016.08); *F21Y 2115/10* (2016.08)

(58) Field of Classification Search

CPC ..... F21V 7/005; F21V 3/02
USPC ..... 362/223, 224
See application file for complete search history.

(56) References Cited

U.S. PATENT DOCUMENTS

| | | | | |
|---|---|---|---|---|
| 2,356,654 | A | 8/1944 | Cullman | |
| D141,068 | S | 5/1945 | Maurette | |
| 4,734,836 | A * | 3/1988 | Negishi | F21V 5/043 362/223 |
| D418,626 | S | 1/2000 | Herst et al. | |
| 7,111,964 | B2 * | 9/2006 | Suehiro | G02B 6/0018 362/328 |
| 7,121,675 | B2 * | 10/2006 | Ter-Hovhannisian | A47F 3/001 362/92 |
| D567,425 | S | 4/2008 | Yates | |
| D577,852 | S | 9/2008 | Miyairi et al. | |
| 7,422,347 | B2 | 9/2008 | Miyairi et al. | |

(Continued)

OTHER PUBLICATIONS

Notice of Allowance for U.S. Appl. No. 29/524,980, dated Sep. 20, 2016, 10 pages.

*Primary Examiner* — William J Carter
(74) *Attorney, Agent, or Firm* — Kilpatrick Townsend & Stockton LLP

(57) ABSTRACT

A tri-lobe optic for a linear light source, and related light rails, retrofit kits and light fixtures, are disclosed. The linear light source defines a light emitting region along an axis. The tri-lobe optic includes an optical material having a constant cross-sectional profile along a direction of the axis from a first axial end to a second axial end. The cross-sectional profile includes a first azimuthal side relative to the axis and concave and convex curves relative to the axis. The curves are a first concave curve coupled with the first azimuthal side, a first convex curve, a second concave curve, a second convex curve and a third concave curve. Each of the concave curves defines a lobe of the optical material along the direction of the axis. The cross-sectional profile further includes a second azimuthal side relative to the axis, coupled with the third concave curve.

12 Claims, 7 Drawing Sheets

(56) References Cited

U.S. PATENT DOCUMENTS

| | | | |
|---|---|---|---|
| 7,461,960 | B2 | 12/2008 | Opolka et al. |
| 7,582,913 | B2 | 9/2009 | Huang et al. |
| 7,621,657 | B2 | 11/2009 | Ohkawa et al. |
| D605,329 | S | 12/2009 | Watt et al. |
| D617,935 | S | 6/2010 | Miletich et al. |
| 7,819,557 | B2 | 10/2010 | Schubert et al. |
| D627,095 | S | 11/2010 | Miyairi et al. |
| 7,922,370 | B2 | 4/2011 | Zhang et al. |
| 7,985,009 | B2 | 7/2011 | Ho et al. |
| D646,421 | S | 10/2011 | Chung et al. |
| 8,052,307 | B2 | 11/2011 | Bak et al. |
| 8,070,326 | B2 | 12/2011 | Lee et al. |
| 8,075,157 | B2 | 12/2011 | Zhang et al. |
| 8,106,859 | B2 | 1/2012 | Ohkawa et al. |
| 8,147,100 | B2 | 4/2012 | Yamaguchi et al. |
| 8,172,433 | B2 | 5/2012 | Muschaweck et al. |
| 8,177,391 | B2 | 5/2012 | Ryu et al. |
| 8,210,722 | B2 | 7/2012 | Holder et al. |
| D670,020 | S | 10/2012 | Herremans |
| D677,818 | S | 3/2013 | Steele et al. |
| 8,395,183 | B2 | 3/2013 | Lee et al. |
| 8,425,088 | B2 | 4/2013 | Matsuki et al. |
| 8,430,538 | B2 | 4/2013 | Holder et al. |
| 8,434,911 | B2 | 5/2013 | Matsuki et al. |
| 8,449,150 | B2 | 5/2013 | Allen et al. |
| 8,506,122 | B2 | 8/2013 | Bak et al. |
| 8,585,252 | B2 | 11/2013 | Wanninger et al. |
| 8,602,605 | B2 | 12/2013 | Park et al. |
| 8,613,532 | B2 | 12/2013 | Fujii et al. |
| 8,632,225 | B2 | 1/2014 | Koo et al. |
| 8,777,457 | B2 | 7/2014 | Holder et al. |
| D712,081 | S | 8/2014 | Murata et al. |
| 8,845,142 | B2 | 9/2014 | de Lamberterie |
| D717,483 | S | 11/2014 | Barnes et al. |
| D725,307 | S | 3/2015 | Guercio et al. |
| D730,568 | S | 5/2015 | Mahowald |
| D738,026 | S | 9/2015 | Dungan et al. |
| 9,134,476 | B2 | 9/2015 | Chen |
| D744,146 | S | 11/2015 | Martins et al. |
| D757,332 | S | 5/2016 | Sieczkowski |
| 9,328,893 | B2 | 5/2016 | Strotmann et al. |
| 2006/0091418 | A1 | 5/2006 | Chew |
| 2006/0198144 | A1 | 9/2006 | Miyairi et al. |
| 2007/0070530 | A1 | 3/2007 | Seo et al. |
| 2011/0228528 | A1* | 9/2011 | Yang ..... F21V 5/04 362/235 |
| 2011/0286214 | A1 | 11/2011 | Quinlan et al. |
| 2012/0155073 | A1 | 6/2012 | McCanless et al. |
| 2013/0051031 | A1 | 2/2013 | Sun et al. |
| 2013/0094218 | A1 | 4/2013 | Wang et al. |
| 2013/0114022 | A1 | 5/2013 | Iiyama et al. |
| 2013/0229810 | A1 | 9/2013 | Pelka et al. |
| 2013/0258676 | A1 | 10/2013 | Hyun et al. |
| 2014/0071696 | A1 | 3/2014 | Park, II et al. |
| 2014/0126217 | A1 | 5/2014 | Hand |
| 2014/0160766 | A1 | 6/2014 | Chinniah et al. |
| 2014/0177233 | A1 | 6/2014 | Tseng et al. |
| 2014/0254134 | A1 | 9/2014 | Pelka et al. |
| 2014/0254172 | A1 | 9/2014 | Wang et al. |
| 2016/0033088 | A1 | 2/2016 | Mayfield, III et al. |

* cited by examiner

FIG. 6
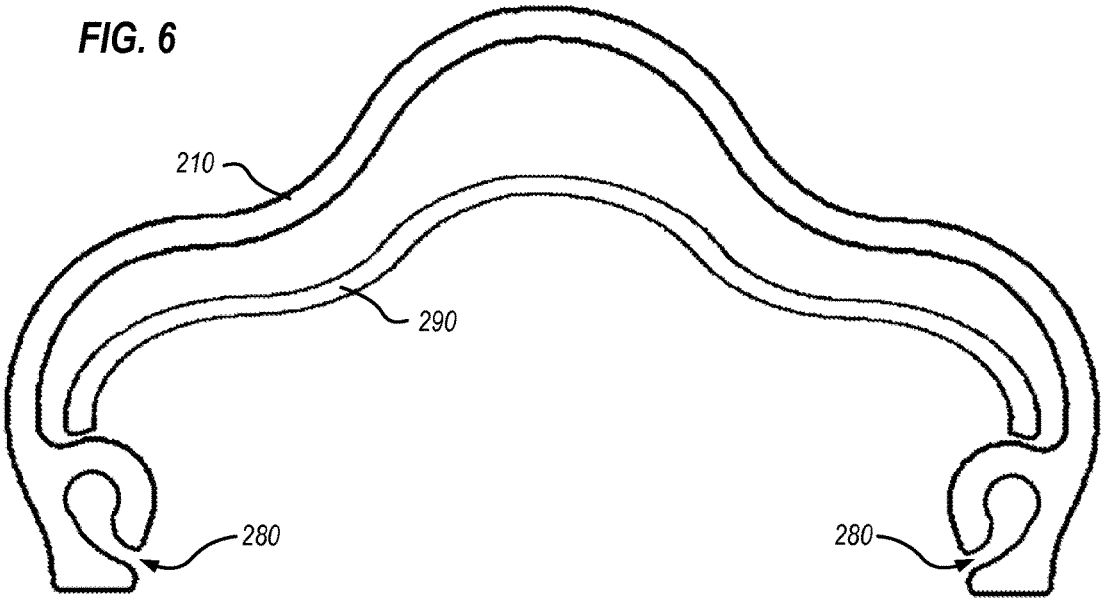
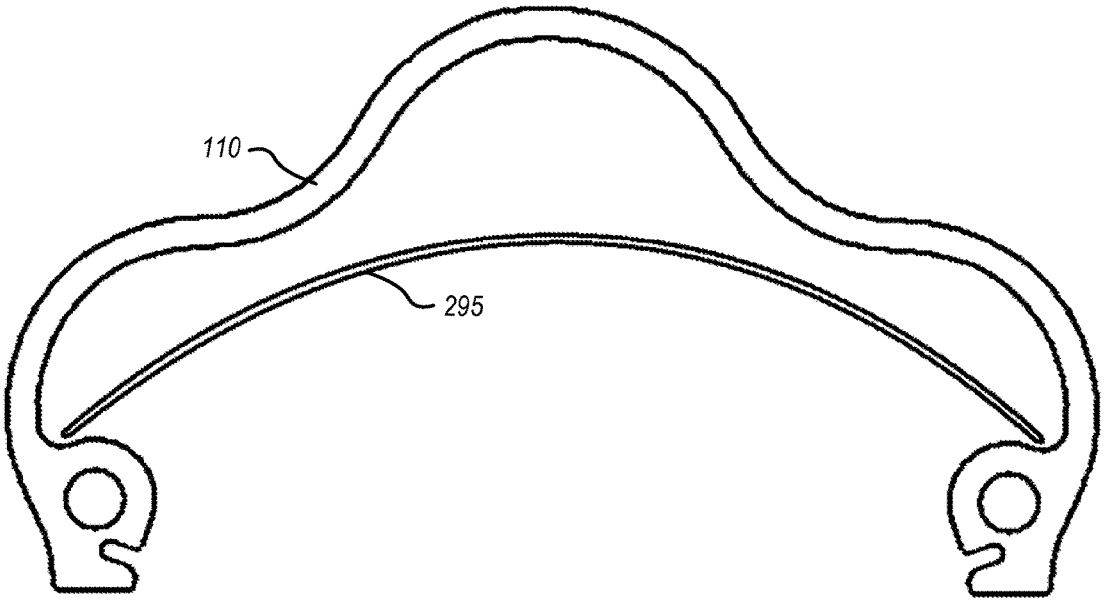
FIG. 7

FIG. 8
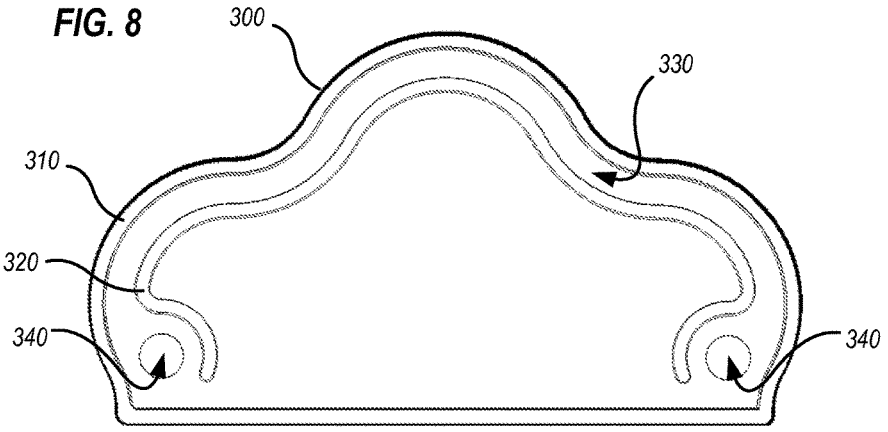
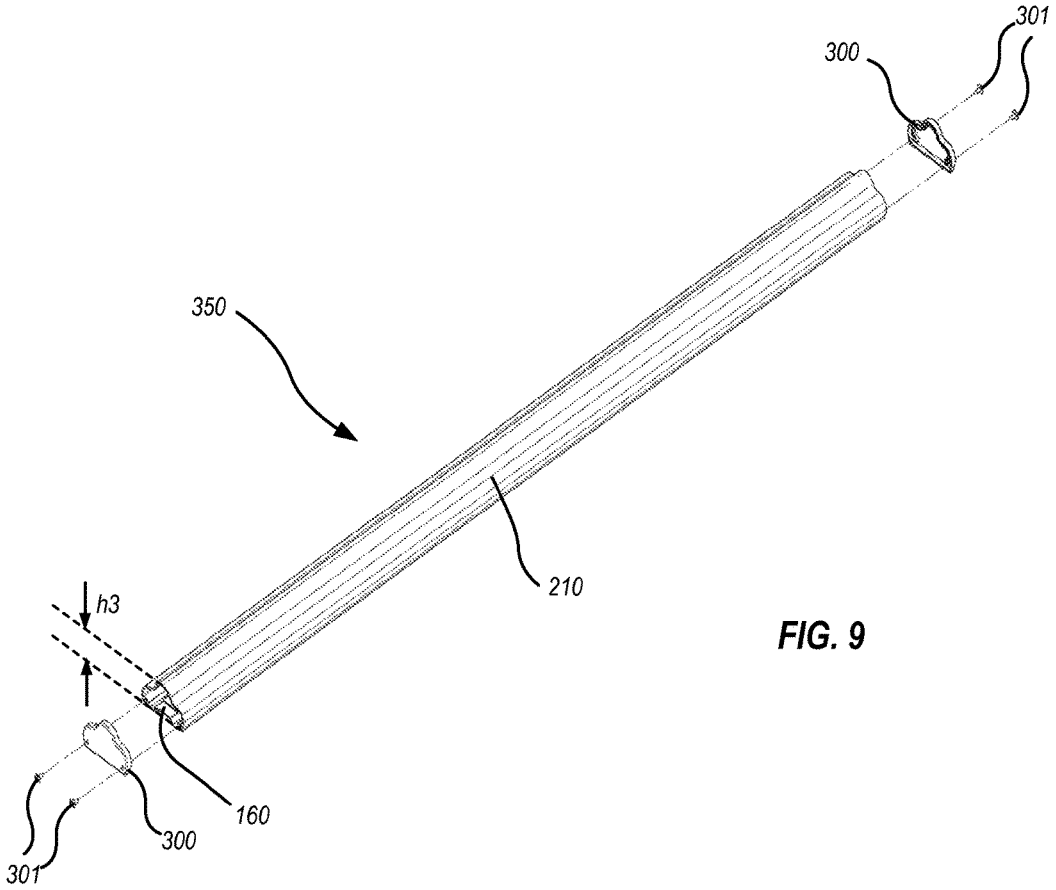
FIG. 9

FIG. 12
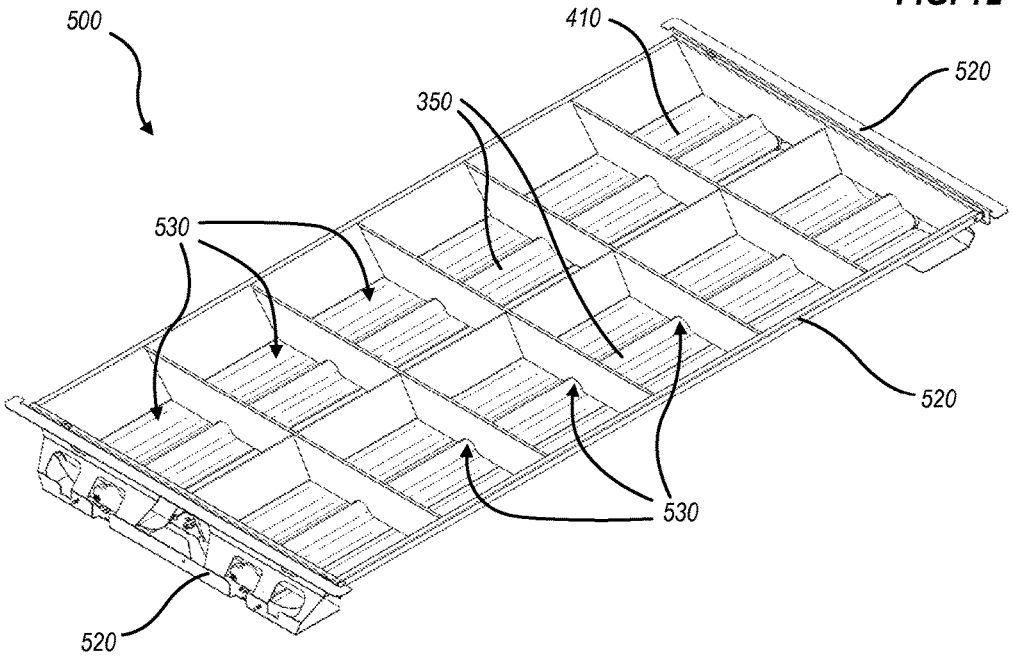
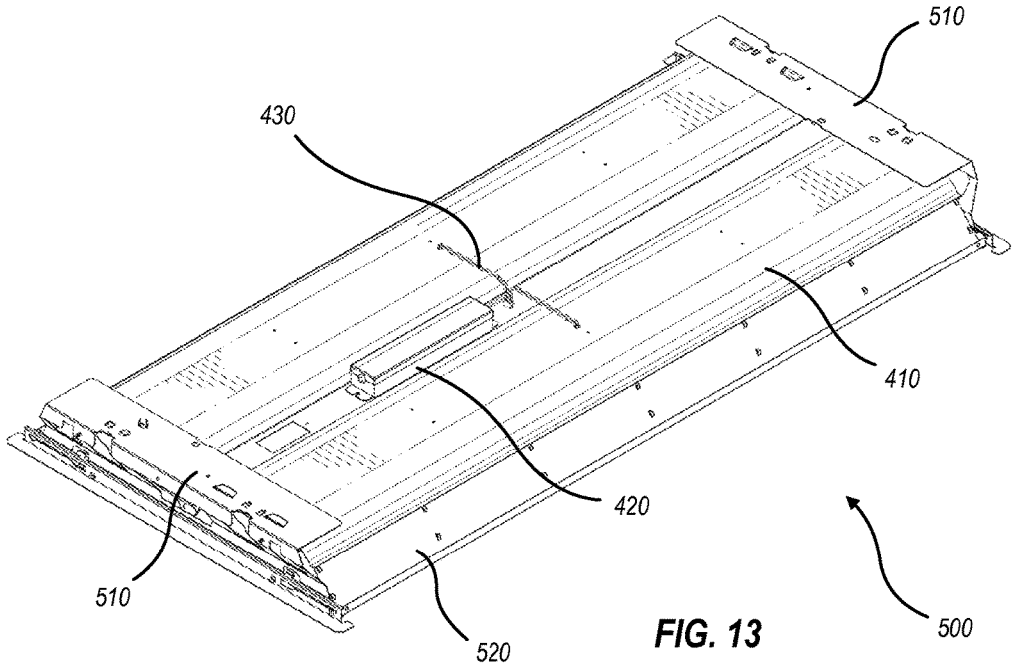
FIG. 13

TRI-LOBE OPTIC AND ASSOCIATED LIGHT FIXTURES

BACKGROUND

Many light fixtures in office buildings, retail stores and other indoor environments utilize so-called "T8" fluorescent tubes that are linear tubes one inch in diameter. These are often featured in "troffer" fixtures that are designed for standard suspended ceiling geometries such as 2×2 feet, 2×4 feet and other sizes. Fluorescent tubes are reasonably energy-efficient light emitters and are relatively comfortable for viewers to look at. However, fluorescent tubes are typically designed for long term degradation and/or failure, due to attack by the plasma that generates the fluorescent light, on components near the ends of the tubes. The ends of the tubes typically darken as the plasma sputters material from the components onto the nearby tube wall, diminishing efficiency and leading to a "dirty" tube look. The damaged components may eventually fail to ignite the plasma at all. Fluorescent tube based light fixtures accommodate this eventual failure by providing a replaceable part interface for the tubes. Certain fluorescent tubes also include trace amounts of mercury that can present a hazard if the tube is broken, and for which reason disposal of used tubes as hazardous material is recommended.

Light emitting diodes (LEDs) are increasingly used as light emitters at the present time due to their high light production efficiency, high reliability, light stability over time and other attributes. Cost of LEDs is currently decreasing as manufacturers increase chip yields. This encourages production of large LED chips as a cost-effective mode of generating the largest amount of usable light generation per LED wafer processed while minimizing downstream costs for testing, packaging and handling that are proportional to the number of chips produced.

SUMMARY

In an embodiment, a tri-lobe optic for a linear light source is disclosed. The linear light source defines a light emitting region along an axis. The tri-lobe optic includes an optical material having a constant cross-sectional profile along a direction of the axis from a first axial end to a second axial end. The cross-sectional profile includes a first azimuthal side relative to the axis and concave and convex curves relative to the axis. The curves are a first concave curve coupled with the first azimuthal side, a first convex curve, a second concave curve, a second convex curve and a third concave curve. Each of the concave curves defines a lobe of the optical material along the direction of the axis. The cross-sectional profile also includes a second azimuthal side relative to the axis, coupled with the third concave curve.

In an embodiment, a light rail for a fluorescent light fixture is disclosed. The light rail includes a light engine that includes a plurality of light emitting diodes (LEDs) coupled with a printed circuit board (PCB), defining a light emitting region and an axis that is centered within the light emitting region and extends along an upper surface of the PCB. The light rail also includes a bracket that extends along a direction of the axis, the PCB coupling with the bracket, and a tri-lobe optic having a constant cross-sectional profile along the direction of the axis. The cross-sectional profile includes a first azimuthal side that forms a first slot for the bracket, and concave and convex curves relative to the axis. The curves are a first concave curve coupled with the first azimuthal side, a first convex curve, a second concave curve, a second convex curve and a third concave curve, such that each of the concave curves defines a lobe of the tri-lobe optic along the direction of the axis. The cross-sectional profile also includes a second azimuthal side coupled with the third concave curve and forming a second slot for the bracket. The light rail also includes two end caps, each of the end caps coupling with a respective first and second one of two axial ends of the tri-lobe optic, such that the end caps enclose the bracket axially and the slots enclose the bracket azimuthally.

In an embodiment, a retrofit kit for a fluorescent light fixture is disclosed. The retrofit kit includes a back plate configured to couple with a frame of the fluorescent light fixture, and two light rails coupled with a first side of the back plate. Each of the light rails includes a light engine that includes a plurality of light emitting diodes (LEDs) coupled with a printed circuit board (PCB) to define a light emitting region. The PCB extends along an axis. Each of the light rails also includes a bracket extending along a direction of the axis. The PCB couples with the bracket. Each of the light rails also includes a tri-lobe optic having a constant cross-sectional profile along a direction of the axis and disposed facing the light emitting region. The LEDs emit light through the tri-lobe optic. The cross-sectional profile includes concave and convex curves relative to the axis. The curves are a first concave curve, a first convex curve, a second concave curve, a second convex curve and a third concave curve. Each of the concave curves defines a lobe of the tri-lobe optic along the direction of the axis. The cross-sectional profile also includes coupling features disposed with azimuthal sides of the cross-sectional profile, for restraining the bracket in a lateral direction. Each of the light rails also includes two end caps that couple with respective first and second axial ends of the tri-lobe optic and about ends of the bracket, for restraining the bracket in an axial direction.

In an embodiment, a light fixture is disclosed. The light fixture includes a frame, a front panel that forms one or more windows for light to emit therethrough, and a back plate configured to couple with the frame. The light fixture also includes one or more light rails coupled with a first side of the back plate and oriented to emit the light through the one or more windows. Each of the light rails includes a plurality of light emitting diodes (LEDs) coupled with a printed circuit board (PCB) to define a light emitting region, the PCB extending along an axis, a bracket extending along a direction of the axis, the PCB coupling with the bracket, and a tri-lobe optic having a constant cross-sectional profile along the direction of the axis and disposed facing the LEDs, such that the LEDs emit the light through the tri-lobe optic. The cross-sectional profile includes concave and convex curves relative to the axis. The curves are, in sequence, a first concave curve, a first convex curve, a second concave curve, a second convex curve and a third concave curve. Each of the concave curves defines a lobe of the tri-lobe optic along the direction of the axis.

BRIEF DESCRIPTION OF THE DRAWINGS

The present disclosure is described in conjunction with the appended figures:

FIG. 6 illustrates an optic that is similar to the optic of FIGS. 3 and 5, in accord with an embodiment.

FIG. 7 again illustrates the optic of FIG. 3, with another optional diffuser, in accord with an embodiment.

FIG. 8 is an internal end view illustrating an end cap 300 for a light rail, in accord with an embodiment.

FIG. 9 is an exploded schematic diagram illustrating components that may be assembled to form a light rail, in accord with an embodiment.

FIGS. 12 and 13 are bottom and top isometric views, respectively, illustrating a troffer type light fixture that includes two of the light rails of FIG. 9, in accord with an embodiment.

DETAILED DESCRIPTION

Figure 1:
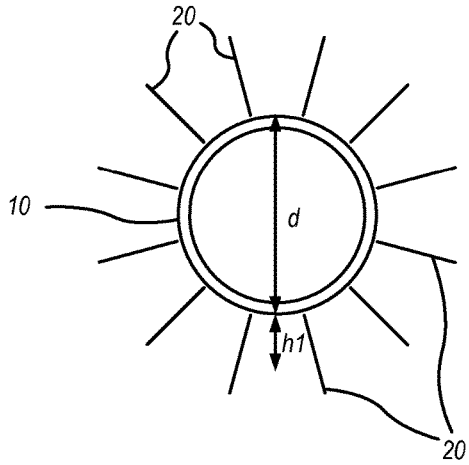
FIG. 1 (PRIOR ART)
FIG. 1 illustrates a light flux density of a prior art T8 fluorescent tube that produces light rays.

The present disclosure may be understood by reference to the following detailed description taken in conjunction with the drawings described below, wherein like reference numerals are used throughout the several drawings to refer to similar components. It is noted that, for purposes of illustrative clarity, certain elements in the drawings may not be drawn to scale. Specific instances of an item may be referred to by use of a numeral in parentheses (e.g., curves 114(1), 114(2), etc.) while numerals without parentheses refer to any such item (e.g., curves 114). In instances where multiple instances of an item are shown, only some of the instances may be labeled, for clarity of illustration.

Large LED chips running at typical light output levels often emit so much light in such a small emitting area that they are uncomfortable to view directly. Embodiments herein recognize this, and provide new and useful functionality for lighting products that utilize LEDs, particularly large LED chips as are desirable for the purpose of providing a low cost, high lumen output, LED based fixture. Certain embodiments herein include optics that spread approximately as much light (generated by LEDs) as a (new) T8 fluorescent tube, over an area equivalent to the light emitting surface area of a T8 tube. By matching the light intensity per unit of emitting area with that of a T8 tube, viewing discomfort is minimized or eliminated. Embodiments herein include the optics, complete fixtures based on them, and retrofit kits for existing fixtures that include intermediate level assemblies.

Figure 2:
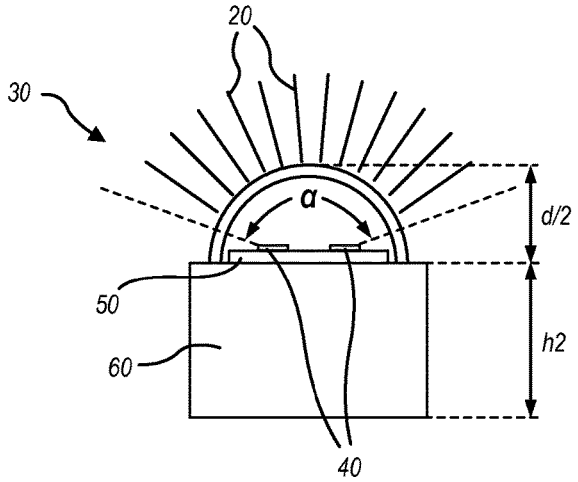
FIG. 2 illustrates a light flux density of an LED based light bar, again illustrated in cross section, that produces the same amount of light as the tube of FIG. 1.
Figure 3:
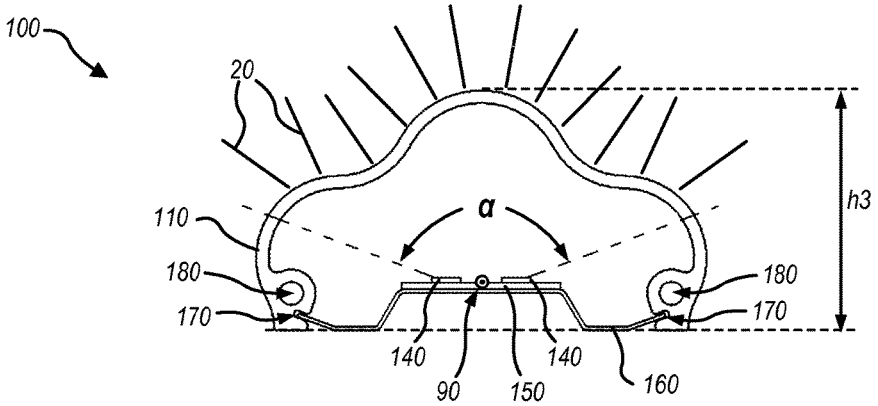
FIG. 3 illustrates a light flux density of an LED based light rail, again illustrated in cross section, that produces the same amount of light as the tube of FIG. 1 or the light bar of FIG. 2, in accord with an embodiment.

FIGS. 1 through 3 illustrate the concept of spreading the illumination from an LED light fixture over a large area in order to minimize light intensity per unit area. FIG. 1 illustrates a light flux density of a prior art T8 fluorescent tube 10 that produces light rays 20. Tube 10 is illustrated in cross section and is thus assumed to continue in and out of the plane shown in FIG. 1. The light flux emitted by tube 10 is characterized as twelve rays 20; only some instances of rays 20 are labeled, for clarity of illustration. Tube 10 is typically mounted with connectors that provide a standoff height h1 between tube 10 and a light fixture.

FIG. 2 illustrates a light flux density of an LED based light bar 30, again illustrated in cross section, that produces the same amount of light as tube 10, this light again being characterized as twelve rays 20. In light bar 30, LEDs 40 are mounted with a printed circuit board (PCB) 50 coupled with a support structure 60, and enclosed within an optic 70 having the same radius of curvature as tube 10. Optic 70 has a geometry of a longitudinal half of tube 10, and thus has a height of d/2. Assuming LEDs 40 are mounted within optic 70 as shown, and that light bar 30 must mount with the same connector and have a maximum height not exceeding that of tube 10 as mounted, this leaves a height h2 for support structure 60, where d/2+h2=d+h1. However, LEDs 40 are not omnidirectional emitters like fluorescent tube 10; light emitting from LEDs 40 is characterized by a useful emitting angle $\alpha$ of about 140 degrees. With the equivalent light flux of fluorescent tube 10 confined within useful emitting angle $\alpha$, light intensity per unit area can be visualized as the density of rays 20 intersecting optic 70, which can be seen as more than double the equivalent density of rays 20 intersecting tube 10 in FIG. 1. A light bars that mounts a PCB with LEDs in the middle of a tube having diameter d leads to the same result, that is, light from the LEDs concentrates within angle $\alpha$, leading to a similar light intensity per unit area as shown in FIG. 2.

FIG. 3 illustrates a light flux density of an LED based light rail 100, again illustrated in cross section, that produces the same amount of light as tube 10 or light bar 30, this light again being characterized as twelve rays 20 that are distributed by an optic 110. In the cross-sectional plane shown in FIG. 3, light rail 100 includes two LEDs 140 that emit light through optic 110 that provides an extended light emitting area, so as to reduce emitted light intensity per unit area. The twelve rays 20 produced by LEDs 140 are spread over the emitting surface but within useful emitting angle of about 140 degrees, as shown. Comparison with FIGS. 1 and 2 shows that the density of rays 20 for light rail 100 is about the same as the density shown for tube 10, FIG. 1 and much less than that shown for light bar 30, FIG. 2. In this way, light from LEDs 140 becomes more comfortable to view, because light rail 100 presents only about the same brightness per unit area as T8 fluorescent tube 10, FIG. 1. Optic 110 couples with a bracket 160 that couples in turn with a PCB 150 that includes LEDs 140; PCB 150 with LEDs 140 operatively coupled therewith are sometimes referred to herein as a light engine.

Optic 110 is formed of an optical material and generally has a constant cross-sectional profile along its length, although features such as apertures or tabs may be fabricated into optic 110 to facilitate mounting and mechanical support. Optical materials utilized to form optic 110 may include acrylic, polycarbonate, silicone or glass, with or without coatings applied thereto. Optic 110 is typically formed by extrusion, but may also be formed by other techniques such as blow molding, vacuum forming, injection molding and continuous casting.

For purposes of accurately identifying features of light rail 100, an axis 90 is defined as extending along an upper surface of PCB 150 (e.g., the surface on which LEDs 140 are mounted), centered within a light emitting region provided by LEDs 140. Thus, PCB 150 and optic 110 extend along an axial direction relative to axis 90, while useful emitting angle $\alpha$ is generally in an azimuthal direction relative to axis 90 (although useful emitting angle $\alpha$ is measured with respect to edges of a light emitting region, rather than axis 90 itself; see FIG. 4). Optic 110 may have a clear finish or a diffusive finish (e.g., one or more textured or "frosted" surfaces). Optic 110 may simply transmit and/or diffuse light, and may also (optionally) incorporate one or more phosphors to modify a spectrum of light emitted by associated LEDs (e.g., to provide a "remote phosphor" capability).

An overall height of optic 110, measuring perpendicularly with respect to axis 90 from a bottom to an apex of the optic, as shown, is denoted as h3. In embodiments, bracket 160 does not extend below optic 110, although this is not required (e.g., bracket 160 can be modified as appropriate when other features of a light fixture that includes light rail 100 are arranged so as to accommodate an extra height if bracket 160 extends beneath optic 110). In a particular embodiment, height h3=d+h1=d/2+h2, such that optic 110 can fit into a fixture originally designed for fluorescent tube 10 or light bar 30. Optic 110 also defines coupling features 170 for bracket 160, and coupling features 180 for end caps (discussed below) to enclose ends of light rail 100, within each azimuthal side of optic 110.

Figure 4:
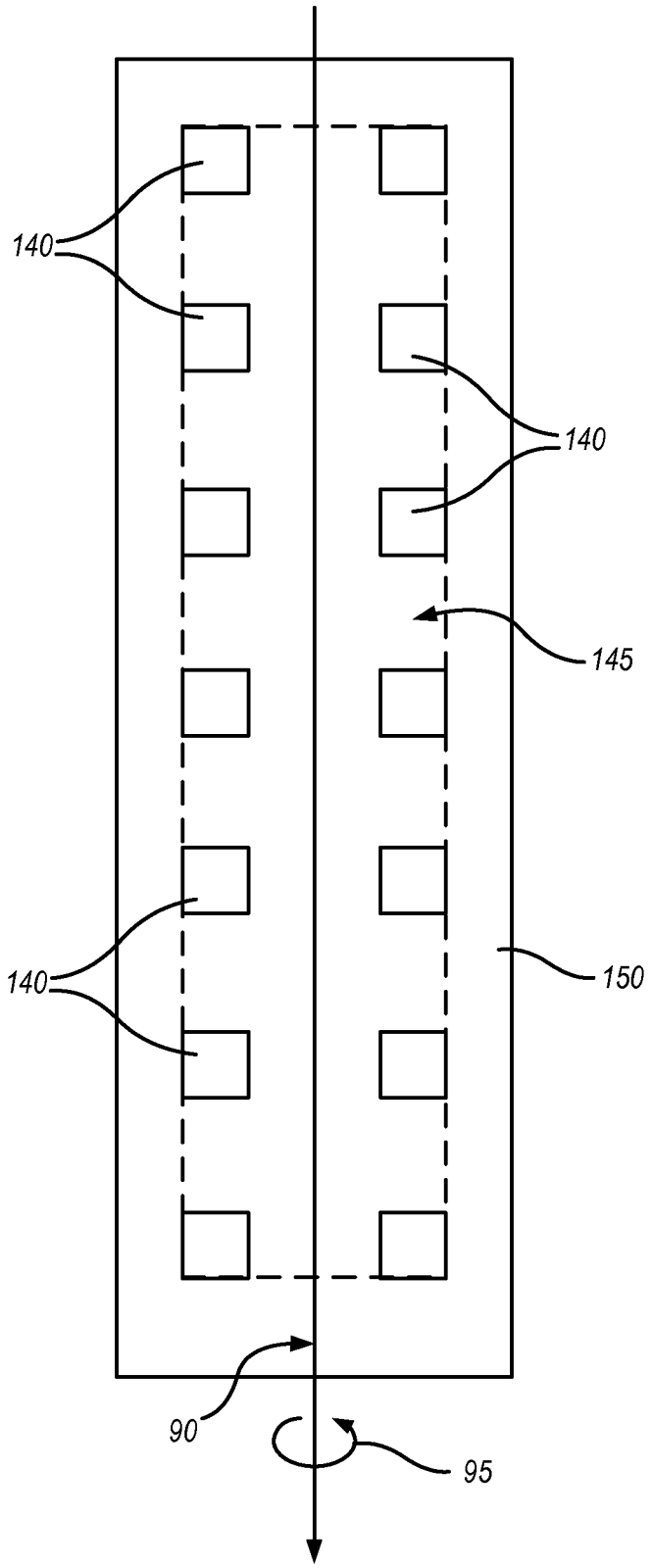
FIG. 4 is a plan view of an exemplary printed circuit board (PCB) further illustrating an axis and a light emitting region associated with the PCB, in accord with an embodiment.

FIG. 4 is a plan view of an exemplary PCB 150 further illustrating an axis 90 and a light emitting region 145 associated with PCB 150. LEDs 140 are coupled with PCB 150; light emitting region 145, bounded by a broken line in FIG. 4 encompasses all LEDs 140. With light emitting region 145 defined in this way, useful emitting angle $\alpha$ discussed above is measured not from axis 90, but from edges of light emitting region 145, so as to describe any portion of optic 110 that lies within a useful light emitting angle from any of LEDs 140. An azimuthal direction 95 is defined as a direction of rotation about axis 90, as shown. The layout of LEDs 140 shown in FIG. 4 to illustrate a light emitting region is exemplary only; layouts of single rows of LEDs 140, more than two rows of LEDs 140 and the like are contemplated.

Figure 5:
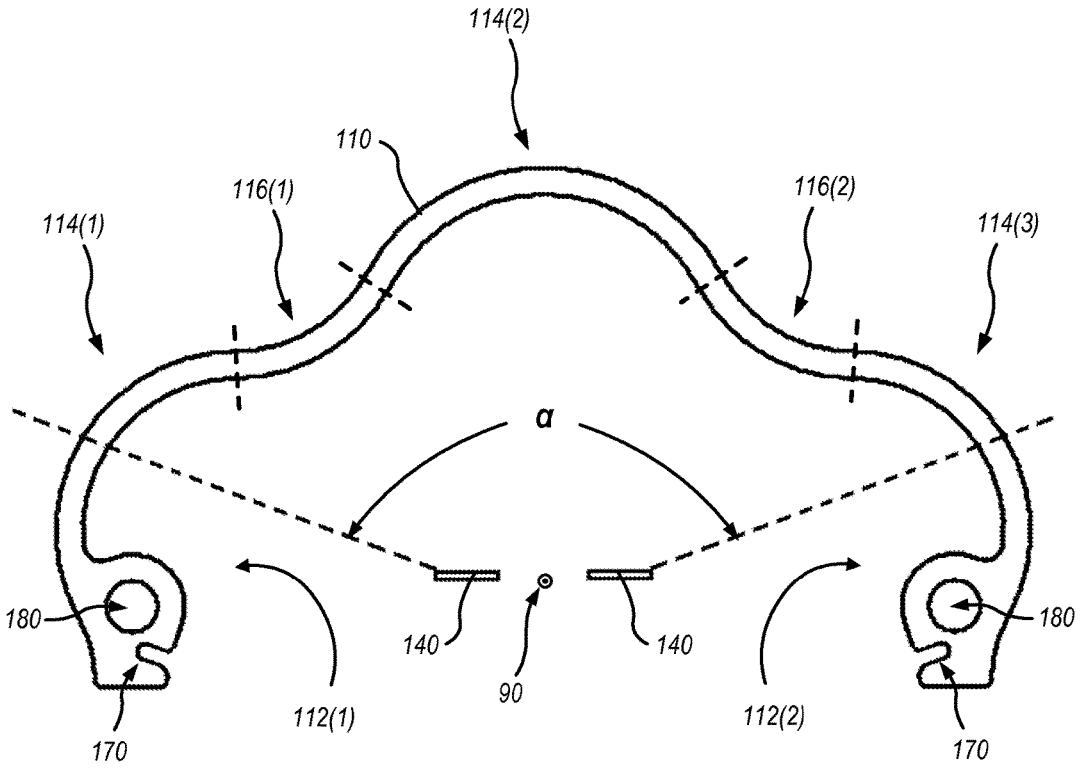
FIG. 5 is a detailed end view of an optic, illustrating LEDs in the positions shown in FIG. 3 and showing features of the optic that lie within a useful emitting angle relative to the LEDs, in accord with an embodiment.

FIG. 5 is a detailed end view of optic 110, illustrating LEDs 140 in the positions shown in FIG. 3 and showing features of optic 110 that lie within useful emitting angle $\alpha$, separated by broken lines. A cross-sectional profile of optic 110 includes first and second azimuthal sides 112-1 and 112-2 respectively; each of azimuthal sides 112-1 and 112-2 includes coupling features 170 and 180 as discussed above. Coupled, in sequence, between azimuthal side 112-1 and azimuthal side 112-2 are three curves 114-1, 114-2 and 114-3 that are concave with respect to axis 90, and two curves 116-1 and 116-2 that are convex with respect to axis 90. Each of the concave curves defines one of lobes 118-1, 118-2 and 118-3 of optic 110 along the direction of axis 90, such that optic 110 may be thought of as a "tri-lobe" optic. In an embodiment, arc lengths of curves 114, 116 are chosen to match an overall circumference of a T8 fluorescent tube. For example, arc lengths of curves 114(1) and 114(3) (only counting portions that lie within useful emitting angle $\alpha$, between the broken lines that cross optic 110) may be about 0.51 inches, arc lengths of curves 116 may be about 0.45 inches, and an arc length of curve 114(2) may be about 1.21 inches. The sum of the arc lengths of curves 114(1), 114-2, 114-3, 116-1 and 116-2 is thus 3.14 inches, the same as the circumference of a T8 fluorescent tube. Thus, optic 110 can be thought of as an "unzipped" equivalent of a T8 fluorescent tube, in the sense of the surface area of a T8 tube being cut lengthwise and the sides rolled back to form the shape of optic 110. When LEDs 140 are chosen and powered to emit the same amount of light as a (new) T8 tube, a light fixture that includes optic 110 and LEDs 140 will provide the same light flux density per unit area, over the useful emitting angle, as the T8 tube.

The number and shapes of lobes 118-1, 118-2 and 118-3, and total arc lengths of the curves defining the lobes, may vary within certain ranges and still spread the light flux density of an LED light engine over an area to make the associated light fixture acceptable to view directly. For example, in embodiments, arc lengths of the first and third concave curves may be within the range of 0.4 to 0.6 inches within the 140 degree azimuthal range from the light emitting region, arc lengths of the first and second convex curves may be within the range of 0.4 to 0.6 inches, and an arc length of the second concave curve may be within the range of 0.9 to 1.6 inches. A total arc length of the cross-sectional profile may be within the range of 2.5 to 4 inches within the 140 degree azimuthal range from the light emitting region.

FIG. 6 illustrates an optic 210 that is similar to optic 110 shown in FIGS. 3 and 5, with the exception that optic 210 forms open channels 280 at both azimuthal sides thereof, with each channel 280 being configured to receive both an end cap fastener and bracket 160, FIG. 3, or other feature that can slide into one or both channels 280. Forming optic 210 without a closed internal feature (e.g., like feature 180, FIG. 3) may reduce fabrication difficulty and/or cost, as compared to forming optic 110 having feature 180. FIG. 6 also illustrates an optional diffuser 290 that may be inserted between LEDs 140 (see FIGS. 3, 4, 5) and optic 210. Diffuser 290 further blends light from LEDs 140 so that the light is not as concentrated at positions of LEDs 140, for increased viewer comfort. Diffuser 290 is optional and may decrease efficiency of an associated light fixture (e.g., by converting a fraction of light from the LEDs, to heat). Diffuser 290 may be provided instead of, or in addition to, a diffusive or "frosted" surface of optic 210. Like optics 110, 210, diffuser 290 may also simply transmit and/or diffuse light, and may also (optionally) incorporate one or more phosphors to modify a spectrum of light emitted by associated LEDs (e.g., to provide a "remote phosphor" capability).

FIG. 7 again illustrates optic 110 as previously discussed, with a differently shaped, optional, diffuser 295. It will be evident to one skilled in the art through the illustrations provided by diffusers 290 and 295 that diffusers for optics herein may be of many possible shapes. Characteristics that may be relevant but not critical for diffusers are that such diffusers fit within an associated optic, and diffuse light but retain high light transmission efficiency. Diffusers may or may not be continuous sheets, and may or may not include phosphors for modifying a spectrum of light emitted by associated LEDs. A diffuser in the form of a thin sheet could also be applied to an outer surface of an associated optic.

FIG. 8 is an internal end view illustrating an end cap 300 for a light rail. End cap 300 mates with any of optics 110, 210 and bracket 160 with an associated PCB to form a light rail. End cap 300 features an optional outer rib 310 and an optional inner rib 320 that define a channel 330 between. When present, as shown in FIG. 8, ribs 310 and 320 serve to stiffen end cap 300, and form channel 330 to at least some extent in order to exclude dust, bugs and the like, as also discussed below. That is, channel 330 lengthens a path that such dust, bugs and the like would have to travel to enter a space between bracket 160 and optic 210, from outside the light rail, but this is not required. FIG. 8 shows channel 330 as an open channel, that is, inner rib 320 does not continue around an inner periphery of end cap 300 nor does it meet with outer rib 310 so as to enclose channel 330, but a closed channel 330 is possible in other embodiments. End cap 300 also defines apertures 340 for fasteners to pass through and engage ends of an optic, as also discussed below.

FIG. 9 is an exploded schematic diagram illustrating components that may be assembled to form a light rail 350. Optic 210 receives bracket 160 in channels (shown more clearly in FIGS. 3 and 5-7) so as to restrain bracket 160 in a lateral direction. End caps 300 couple with optic 210 and bracket 160, so as to restrain bracket 160 in an axial direction, as shown. In the embodiment shown in FIG. 9, end cap fasteners 301 extend through end caps 300 and couple with channels of optic 210, as shown. However, certain end cap fasteners can be fabricated as part of end caps themselves, for example as dowels or pegs integrated with the end caps that can be press-fit into channels of the associated optic. In embodiments intended for indoor use, end caps 300 and bracket 160 fit snugly with one another and with optic 210, to exclude dust, bugs and the like from the space between bracket 160 and optic 210. In embodiments intended for outdoor use, elastic materials, gaskets and/or sealing materials (e.g., tape, glue and the like) may optionally be used to form seals among end caps 300, bracket 160 and optic 210. Wires may be electrically connected with circuit traces on PCB 150 and brought out through PCB 150 and/or bracket 160, to connect with external power. In embodiments, light rail 350 may be manufactured to any length to suit a given lighting application. Also, in embodiments, a net height h3 of light rail 350 does not exceed a height of (d+h1) where d is the (one inch) diameter of a standard T8 tube, and h1 is the height of standard support structure for the T8 tube in the troffer being retrofitted (see FIG. 1). In one specific embodiment, height h3 does not exceed a height of one and three-eighths of an inch (1.375").

Figure 10:
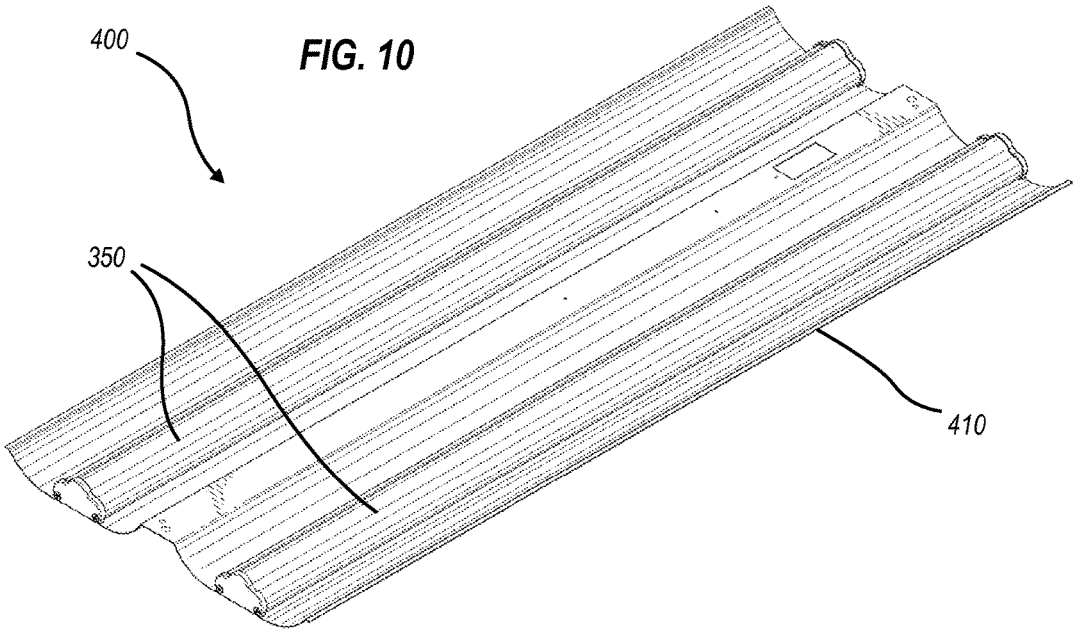
FIGS. 10 and 11 are bottom and top isometric views, respectively, illustrating a retrofit kit based on the light rail of FIG. 9 for a troffer type light fixture, in accord with an embodiment.
Figure 11:
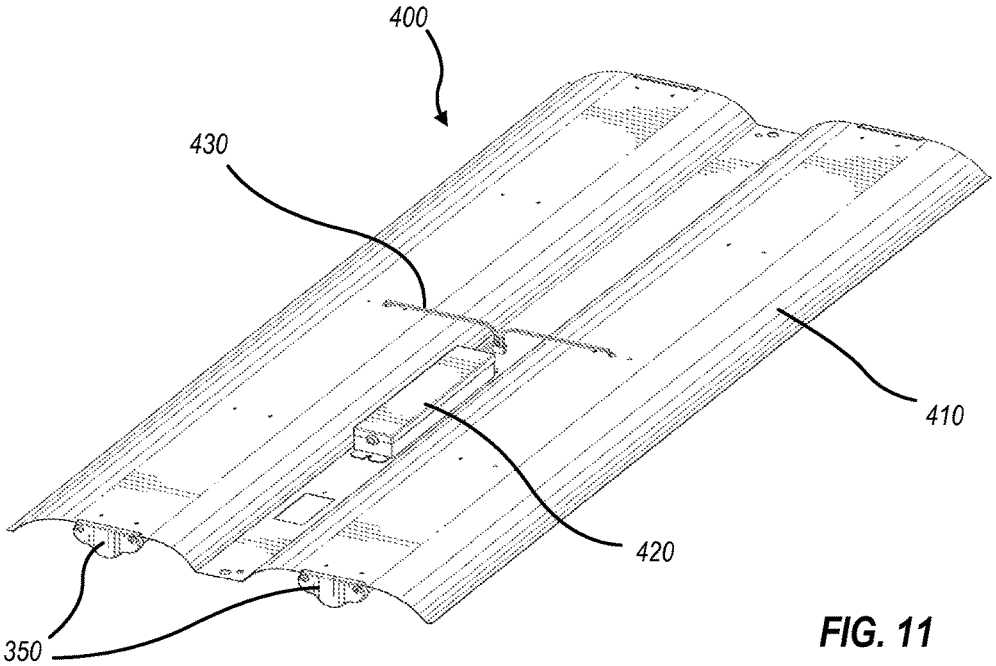

FIGS. 10 and 11 are bottom and top isometric views, respectively, illustrating a retrofit kit 400 based on light rails 350, as described above, for a troffer type light fixture. FIG. 10 shows a pan 410 that provides structural support for two light rails 350. FIG. 11 shows pan 410 with a driver electronics box 420 and wiring 430 that connects driver electronics box 420 with light rails 350. Driver electronics box utilizes standard power (e.g., 110VAC) to provide a low DC voltage (e.g., <=60VDC) current source for operation of light rails 350. Retrofit kit 400 may be offered as a "drop in" replacement for existing troffer fixtures that were originally installed with T8 fluorescent tubes. Advantageously, electronics box 420 may include a socket and/or plug to couple with an existing electrical connector, so that an existing back plate (including fluorescent ballast electronics) can be removed from the troffer being retrofitted, electronics box 420 can be coupled with the existing connector, and the entire retrofit kit 400 can be mechanically coupled into place. Although retrofit kit 400 is illustrated as having two light rails 350 and pan 410 having about a 2×4 aspect ratio, it is contemplated that width of pan 410 may be adjusted, and more or fewer light rails 350 may be implemented alongside one another, to provide a retrofit kit of any desired width, and light rails 350 and pan 410 may be of any desired length, to provide a retrofit kit for a light fixture of any length and width.

FIGS. 12 and 13 are bottom and top isometric views, respectively, illustrating a troffer type light fixture 500 that includes light rails 350. FIG. 12 shows portions of a troffer frame 510 to which a front panel 520 couples. In the embodiment shown, front panel 520 is engaged in the position shown during use, but one side of front panel 520 can disengage from frame 510 such that front panel 520 can open like a door from frame 510 for access to parts therein. Front panel 520 forms windows 530 for light to emit through; the number and placement of windows 530 shown in FIG. 12 is exemplary only, and may vary in embodiments; not all instances of windows 530 are labeled in FIG. 12, for clarity of illustration. Frame 510 and front panel 520 are compatible with T8 fluorescent tube lighting, that is, recesses 540 in upper surfaces of front panel 520 accommodate T8 tubes as mounted, and similarly accommodate light rails 350 designed within the same height constraint as the T8 tubes (only a few recesses 540 are labeled in FIG. 13). Fixture 500 also includes pan 410 and light rails 350, as shown in FIGS. 10 and 11. FIG. 13 also shows portions of troffer frame 510, front panel 520 and pan 410. Additionally visible in FIG. 13 are electronics box 420 and wiring 430, as also shown in FIG. 10.

The foregoing is provided for purposes of illustrating, explaining, and describing various embodiments. Having described these embodiments, it will be recognized by those of skill in the art that various modifications, alternative constructions, and equivalents may be used without departing from the spirit of what is disclosed. Different arrangements of the components depicted in the drawings or described above, as well as additional components and steps not shown or described, are possible. Certain features and subcombinations of features disclosed herein are useful and may be employed without reference to other features and subcombinations. Additionally, a number of well-known processes and elements have not been described in order to avoid unnecessarily obscuring the embodiments. Embodiments have been described for illustrative and not restrictive purposes, and alternative embodiments will become apparent to readers of this patent. Accordingly, embodiments are not limited to those described above or depicted in the drawings, and various modifications can be made without departing from the scope of the claims below. Embodiments covered by this patent are defined by the claims below, and not by the brief summary and the detailed description.

I claim:

1. A tri-lobe optic for a linear light source, the linear light source defining a light emitting region along an axis, the tri-lobe optic comprising:

an optical material forming:

an inner surface and an outer surface; and a constant cross-sectional profile along a direction of the axis from a first axial end to a second axial end, the cross-sectional profile comprising:

a first azimuthal side relative to the axis;

concave and convex curves relative to the axis, the curves being:

a first concave curve coupled with the first azimuthal side, a first convex curve, a second concave curve, a second convex curve and a third concave curve, such that each of the concave curves defines a lobe of the optical material along the direction of the axis; and a second azimuthal side relative to the axis, coupled with the third concave curve;

wherein each of the inner surface and the outer surface follow each of the concave and convex curves between the first azimuthal side and the second azimuthal side.

2. The tri-lobe optic of claim 1, further comprising two end caps, each of the two end caps being configured to couple with a respective one of the first and second axial ends of the optical material.

3. The tri-lobe optic of claim 2, wherein:

each of the end caps couples with the optical material using fasteners; and each of the first and second azimuthal sides defines a feature that accommodates the fasteners.

4. The tri-lobe optic of claim 1, wherein total arc lengths of the cross-sectional profile are substantially equal along each of the inner and outer surfaces, and are within the range of 2.5 to 4 inches within a 140 degree azimuthal range from the light emitting region.

5. The tri-lobe optic of claim 4, wherein:

arc lengths of the first and third concave curves are within the range of 0.4 to 0.6 inches within the 140 degree azimuthal range from the light emitting region;

arc lengths of the first and second convex curves are within the range of 0.4 to 0.6 inches; and an arc length of the second concave curve is within the range of 0.9 to 1.6 inches.

6. The tri-lobe optic of claim 1, wherein the optical material comprises polycarbonate, acrylic, silicone or glass.

7. The tri-lobe optic of claim 1, further comprising a diffuser disposed between the linear light source and the optical material.

8. The tri-lobe optic of claim 7, wherein one of the diffuser and the optical material comprises a phosphor.

9. The tri-lobe optic of claim 1, further comprising the linear light source, the linear light source comprising a plurality of light emitting diodes (LEDs) coupled with a printed circuit board (PCB) to define the light emitting region.

10. The tri-lobe optic of claim 9, further comprising a bracket extending from the first axial end to the second axial end, the PCB coupling with the bracket, the first and second azimuthal sides of the optical material defining a slot for the bracket.

11. The tri-lobe optic of claim 10, further comprising two end caps, each of the two end caps coupling with respective ones of the first and second axial ends of the optical material, such that the end caps and the slots enclose the bracket.

12. The tri-lobe optic of claim 1, wherein the optical material is formed by one of extrusion, blow molding, vacuum forming, injection molding and continuous casting.

* * * * *